US005725107A

United States Patent [19]

Dembicks

[11] Patent Number: 5,725,107

[45] Date of Patent: Mar. 10, 1998

[54] LOCKING HOLDER FOR INTERCHANGEABLE BIT MEMBER

[76] Inventor: Andrew E. Dembicks, 5308 Boca Marina Cir. North, Boca Raton, Fla. 33487

[21] Appl. No.: 530,767

[22] Filed: Sep. 19, 1995

[51] Int. Cl.[6] ..... A47F 7/00

[52] U.S. Cl. ..... 211/70.6; 211/89; 211/94; 206/378

[58] Field of Search ..... 211/70.6, 94, 89; 248/309.1, 309.2, 222.52, 222.13; 206/378, 493

[56] References Cited

U.S. PATENT DOCUMENTS

| | | | |
|---|---|---|---|
| 4,043,453 | 8/1977 | Greenlee | 211/70.6 X |
| 4,450,961 | 5/1984 | Bies et al. | 211/69 X |
| 4,621,738 | 11/1986 | DeLucchi | 211/70.6 |
| 4,717,106 | 1/1988 | Bies et al. | 211/70.6 X |
| 4,826,021 | 5/1989 | Burrell | 211/70.6 |
| 5,228,570 | 7/1993 | Robinson | 211/70.6 X |
| 5,279,420 | 1/1994 | Rodgers | 206/493 X |
| 5,335,772 | 8/1994 | Chervenak et al. | 206/493 X |
| 5,398,823 | 3/1995 | Anders | 211/70.6 |

OTHER PUBLICATIONS

Sears/Craftsman Power and Hand Tools Catalog, 1995–1996, p. 11, Item AA, "Craftsman Steel Socket Carry Rack".

*Primary Examiner*—Robert W. Gibson, Jr.
*Attorney, Agent, or Firm*—Quarles & Brady

[57] ABSTRACT

An apparatus is disclosed for the secure storage of sockets for ratchet wrenches and other types of interchangeable bit members for tools such as screwdrivers, nut drivers, routers, etc., having integral shafts or shaft receiving members. The invention includes a system for securely holding one or more of a set of detachable bits, used with ratchet wrenches or other tools, by means of a cam-actuated rotator member mounted within a channel guide. Further, a novel socket display apparatus is disclosed which provides a secure mounting system for the cam actuated receiving unit. The socket display apparatus provides for snap lock engagement of the display apparatus with a ratchet wrench socket or other tool bit whereby the socket or bit may only be removed by destroying the display unit.

21 Claims, 5 Drawing Sheets

LOCKING HOLDER FOR INTERCHANGEABLE BIT MEMBER

BACKGROUND OF THE INVENTION

1. Field of the Invention

The present invention relates to the secure storage of sockets for ratchet wrenches and interchangeable bit members for other types of tools such as screwdrivers, nut drivers, routers, etc., having integral shafts or shaft receiving members. The invention includes a cam-actuated socket or bit receiving unit mounted within a channel guide. Further according to the invention, a novel display apparatus is disclosed which incorporates the cam actuated socket receiving unit.

2. Description of the Prior Art

Ratchet wrenches of the kind which are used by professional and amateur mechanics commonly include a gripping handle integrally formed with a ratchet head unit. The ratchet head unit generally includes a male sexed ratchet drive nub operationally connected to a reversible ratchet mechanism positioned within the ratchet head. Detachable sockets are available for use with such ratchets which include a drive aperture dimensioned to receive male sexed ratchet drive nubs of certain standard sizes. For example, standard sized drive nubs may be ¼, ⅜ or ½ inches square. On an opposite end of the socket there is typically provided a second aperture designed to securely engage a nut or the head of a bolt.

It is often desirable to store a series of sockets for ratchet wrenches in an organized manner so that various socket sizes for use with different size nuts and bolts may be easily located. Systems of the prior art for storing such sockets have included elongated metal rack systems with resilient male-engaging members for engaging the drive end of a socket to be stored thereon. Significantly, however, such systems suffer from a serious drawbacks in that, if they are dropped on the floor or roughly handled, sockets mounted thereon will tend to be knocked off the rack, and thereby become disorganized. Furthermore, such systems typically suffer from corrosion problems due to the necessity of manufacturing such items from metal. To date, no economical and commercially available socket-storage systems have been available which have overcome the problem of securely holding a socket in a convenient, releasable manner. A similar problem exists with respect to interchangeable bit members for other types of tools such as screwdrivers, nut drivers, routers, etc., having integral shafts or shaft receiving members.

SUMMARY OF THE INVENTION

The present invention provides a novel and commercially-attractive system for the storage of ratchet wrench sockets and interchangeable bit members for other types of tools such as screwdrivers, nut drivers, routers, etc., having integral shafts or shaft receiving members, which can be economically manufactured using injection molding and extrusion techniques.

In a first embodiment, the invention is designed to accommodate ratchet wrench sockets and other types of interchangeable bit members having shaft receiving members. For convenience, this embodiment will be described in terms of a ratchet wrench socket. However, it should be understood that the embodiment is not so limited and it may be used with any type of bit member (including a ratchet wrench socket) which has a shaft receiving member.

Briefly, the first embodiment is comprised of a rotator member and a channel guide. The rotator member is formed from a planar base portion which is formed transversely to a central rotator member axis. The rotator member base is formed with an eccentric cam surface defined on its outer periphery which includes at least two parallel opposing cam-locking faces. A substantially cylindrical lower body is formed on top of the base, and projects axially upward therefrom. The lower body has a diameter which is smaller than the diameter of the largest imaginary circle which could be drawn completely inside the perimeter of the base. Further, the approximately circular perimeter defined by the lower body portion is inwardly offset from the perimeter of the eccentric cam surface such that a shoulder is defined on the upper surface of the base which is bounded by the outer cylindrical surface of the lower body member.

A socket-receiving member is provided axially aligned with and projecting upwardly from the lower body. The socket-receiving member is advantageously comprised of a box member formed on an upper surface of the lower body and a cylindrical alignment head projecting upwardly from the box member. Further, a rotator arm may be formed outwardly projecting from the rotator member, spacedly offset from the base. If a rotator arm is utilized with the invention, it is preferably attached to an upper portion of the lower body member. Alternatively, the invention can function without a rotator arm, particularly in instances where a relatively large diameter socket is to be stored on the socket receiving member. As explained below, use of the invention with a large diameter socket provides sufficient mechanical advantage to allow a user to rotate the rotator member without the need for a rotator arm.

According to this first embodiment of the invention, the base portion, the lower body portion and the socket-receiving member are substantially divided along the central rotator member axis to form two opposing sides separated by a gap. The two sides are joined together by a resilient bridge member which may be integrally formed with each of the opposing sides. The resilient bridge member is preferably connected to opposing sides of the lower body portion at approximately a mid-point along the axis of the rotator member.

The channel guide is provided for receiving the base portion of the rotator member in a manner permitting rotation and lateral sliding of the socket holder within the guide. The channel guide includes opposing channel side walls formed parallel to one another, and projecting upwardly along the length of an elongated rectangular channel base. A retaining lip is defined on a upper edge of each of the side walls, protruding inwardly toward a center line of the channel guide, for retaining the base portion of the rotator member in position between the side walls.

As noted above, the eccentric cam surface includes at least two parallel opposing cam-locking faces for maintaining the rotator member in a rotationally stationary locking position relative to the channel guide means. The rotator member is rotationally locked when the two parallel opposing cam-locking faces engage the side walls. Further, the eccentric cam surface includes at least one resilient edge member to provide a spring-like engagement between the eccentric cam surface and the channel guide when the rotator member is rotated into its rotationally locked position.

In a second embodiment of the invention designed for operation with interchangeable bit members having integral shafts (as opposed to shaft receiving members), the invention is generally formed as described above. However, in place of the socket-receiving member described in the previous embodiment, a shaft receiving member is provided axially aligned with and projecting upwardly from the lower body. The second embodiment will be described generally with reference to interchangeable bit members having integral shafts. It should be understood however that such interchangeable bit member terminology is intended to include all manner of bits having integral shafts, including certain types of ratchet wrench sockets.

According to the second embodiment, the shaft receiving member is advantageously comprised of an outer casing defining an inner bore along the rotator member axis. As with the previous embodiment, a rotator arm may be formed outwardly projecting from the rotator member, spacedly offset from the base and is preferably attached to an upper portion of the lower body member.

According to the second embodiment of the invention, the base portion, the lower body portion and the shaft receiving member are substantially divided along the central rotator member axis to form two opposing sides separated by a gap. The two sides of the outer casing forming the shaft receiving member are joined together by a resilient bridge member. The resilient bridge member is integrally formed with each of the opposing sides forming the outer casing substantially at the distal end of the shaft receiving member, opposite from the base portion. In this manner, when the rotator member is pivoted within the channel guide so that the eccentric cam members engage the channel guide side walls, the opposing sides will pivot or flex on the resilient bridge member and compress toward the rotator member central axis. Consequently, a shaft from an interchangeable bit member will be frictionally engaged by the outer casing forming the opposing sides of the shaft receiving member and will thereafter be maintained in position.

Further according to the invention, a display part is provided for facilitating convenient display of a socket in a retail environment. The display part interfits with the rotator unit so as to cause the rotator member to securely engage a socket thereon, without the need for any channel guide. More specifically, the display part includes a tab portion with a hook aperture and two rotator member receiving arms formed thereon. The hook aperture is provided to allow convenient hanging placement of the display part on a display board in a retail outlet and is formed on any convenient part of the tab portion. The receiving arms project from one edge of the tab portion and angle toward one another in a common plane, in a direction away from the tab edge from which they project. The receiving arms are connected at their distal ends by a U-shaped head unit. The head unit is comprised of two parallel spaced frangible lugs each connected on one end to a distal end of one of the receiving-arms and on an opposite end to a connector portion. The frangible lugs, connector portion and receiving arms are formed in a common plane and have a thickness approximately equal to the gap formed between opposing sides of the rotator unit described above. Further, the frangible lugs are spaced apart from one another a distance approximately equal to a distance W associated with the width of the resilient bridge member formed on the rotator unit. The frangible lugs each have formed on an outwardly facing surface a socket engaging nub for engaging a socket drive aperture. The receiving arms are flexible and can be bent 90 degrees to allow for the efficient insertion of the U-shaped head unit into a ratchet wrench socket by means of automatic assembly equipment.

In order to use the display part according to the invention, the rotator member is positioned between the receiving arms with the cylindrical alignment head facing the display part connector portion. The rotator member is then slid into engagement with the display part so that the frangible lugs and connector member snugly interfit with the gap formed between opposing sides of the rotator member. According to the invention, the frangible lugs are designed to match the outside profile of the rotator member except for the socket engaging nubs, which protrude outwardly from the rotator member in the area of the cylindrical alignment head. Once the display part has been securely interfitted with the rotator member, a ratchet socket may then be mounted on the interfitted combination with the socket drive aperture inserted onto the socket receiving member. In such case, the socket engaging nubs formed on the display part will lock into a socket drive aperture, thereafter preventing removal of the socket.

Once mounted on the interfitted combination of the display part and rotator member, a socket can only be removed by destroying the display part. More specifically, in order to remove a socket a user must exert a force upon the interfitted combination sufficient to shear one of the frangible lugs off the receiving arms or break the connection between the frangible lugs and the connector portion. Either of these actions will destroy the structural support maintaining the socket engaging nubs locked into position within the drive aperture of a socket, thus permitting the socket to be freely removed.

DETAILED DESCRIPTION OF THE INVENTION

Figure 1:
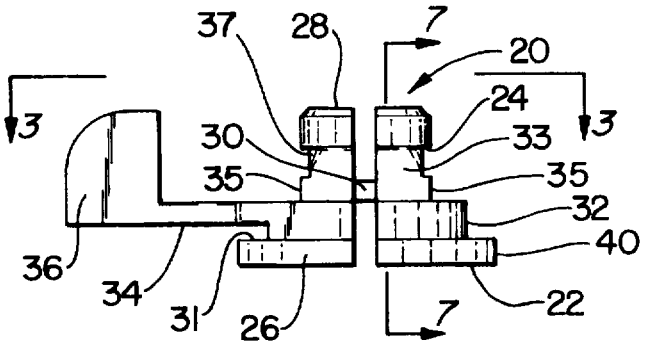
FIG. 1 is a side elevation view of a first embodiment of the rotator member according to the invention.
Figure 2:
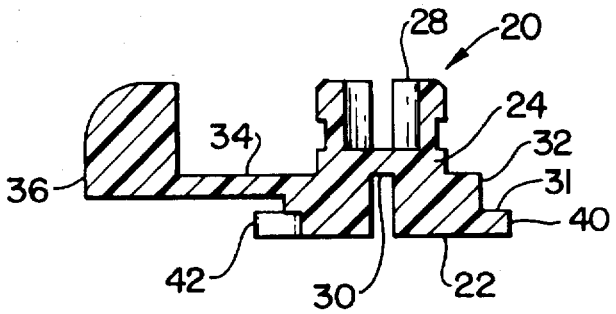
FIG. 2 is a sectional view of the rotator member taken substantially along line 2—2 in FIG. 3.
Figure 3:
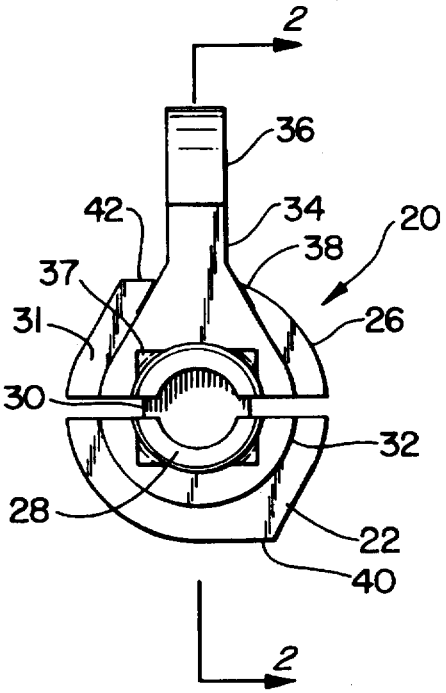
FIG. 3 is a top view of the rotator member.

As shown in FIGS. 1–10, a socket holder system is disclosed which includes a rotator member 20, and a channel guide 44. The rotator member 20 includes a flattened or planar base section which includes an eccentric cam surface 26 formed on its outer periphery. The eccentric cam surface is radially non-symmetric about a central axis defined as passing transversely through the planar surface of base 22. On the top surface of the base 22 is formed a lower body 32 which is approximately cylindrical in shape. The cylindrical lower body 32 has a diameter which is smaller than the diameter of the smallest imaginary circle which could be drawn completely inside the perimeter of the base 22. Further, the circular perimeter defined by the lower body 32 is inwardly offset from the perimeter of the eccentric cam surface 26 such that a shoulder 31 is defined on the upper surface of the base 22 which is bounded by the outer cylindrical surface of the lower body 32. On an upper surface of the cylindrical lower body, a socket-receiving member 24 is formed. Socket receiving member 24 is comprised of a box member 33 formed on an upper surface of the cylindrical lower body, which box section is advantageously dimensioned to inter-fit with a standard drive aperture formed on a socket. Typically, the box member will be dimensioned to snugly nest within a ¼", ⅜" or ½" square drive aperture formed on a socket for a wrench, as is well known in this industry.

In a preferred embodiment, a cylindrical alignment head 28 is provided on top of the box member 33. Cylindrical alignment head 28 is preferably dimensioned to have a diameter approximately equal to each of the sides forming box member 33. In this manner, the cylindrical alignment head may be fitted in a socket drive aperture to align the axis of the socket aperture with the box member. A bevel 37 is preferably defined on each of the upper corners of the box member to assist in guiding a socket drive aperture past the cylindrical alignment head and onto the box member 33. Further, a box member lip 35 is preferably formed on at least two opposing side walls forming the box member to more securely engage a socket drive to be mounted on the socket receiving member 24.

The socket-receiving member 24, cylindrical lower body 32 and box member 33, according to the invention, are divided along the central axis of the rotator member, so as to form two opposing sides separated by a gap. The base 22, socket-receiving member 24 and cylindrical lower body 32 are joined together by a resilient bridge member 30, which connects the opposing sides of the rotator member 20. In a preferred embodiment, the resilient bridge member 30 is formed at approximately the mid-point along the axial length of the rotator member, just above the cylindrical lower body 32. However, the invention is not so limited, and the bridge member may be positioned slightly above or below the axial mid-point.

A rotator arm 34 may be provided attached to the rotator member 20 to assist in allowing the rotator member to be manually rotated on its axis. A paddle member 36 is preferably provided on the rotator arm for conveniently grasping of the arm by a user. It should be noted however that the primary purpose of the rotator arm is to provide the user with a mechanical advantage in rotating the rotator member about its axis. In the case where a sufficiently large diameter socket or other bit member is mounted on the socket receiving member, the socket itself may provide sufficient mechanical advantage for rotating the rotator member so that the rotator arm may be eliminated. For the purpose of clarity, the invention as described herein will include reference to a rotator arm.

According to the invention, the rotator member 20 is positioned within channel guide 44 as shown in FIGS. 7–10. As shown if FIGS. 5 and 6, the channel guide is comprised of an elongated channel base 46, upon which are mounted opposing channel side walls 48, which are parallel and spaced from one another along the length of channel guide 44. At an upper edge of channel side walls 48, a channel-retaining lip 50 is formed which projects inwardly from each of the channel side walls toward a center line defined along the length of the channel guide 44.

Figure 7:
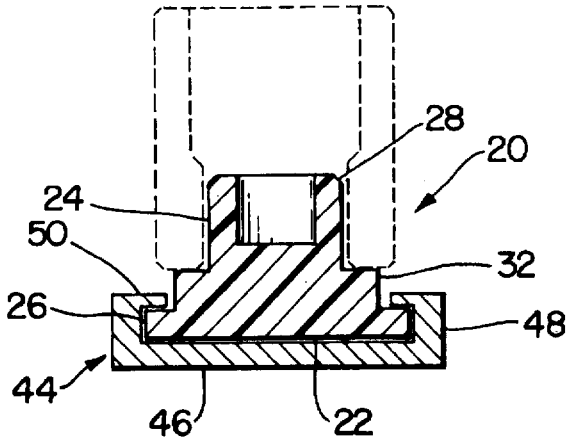
FIG. 7 is a sectional view of the rotator member taken along line 7—7 in FIG. 1, shown positioned in the channel guide.
Figure 8:
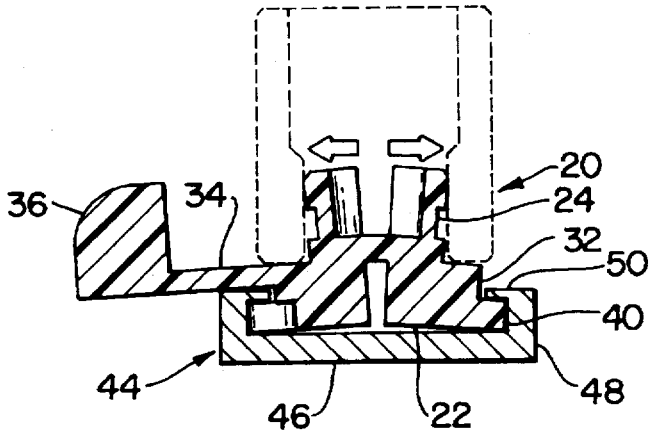
FIG. 8 is a sectional view of the rotator member taken along line 2—2 in FIG. 3, shown positioned within the channel guide in its locked or engaged position.

As shown in FIGS. 7 and 8, shoulder 31 engages channel-retaining lip 50 when the rotator member 20 is positioned within the channel guide 44. In this manner, rotator member 20 may rotated axially, or may slide along the length of channel guide 44, but is otherwise retained therein. The channel side walls 48 are advantageously spaced from one another a distance sufficient to permit rotator member 20 to rotate within the channel guide, but will cause the channel side walls to engage specifically-defined portions of the eccentric cam surface 26.

Figure 4:
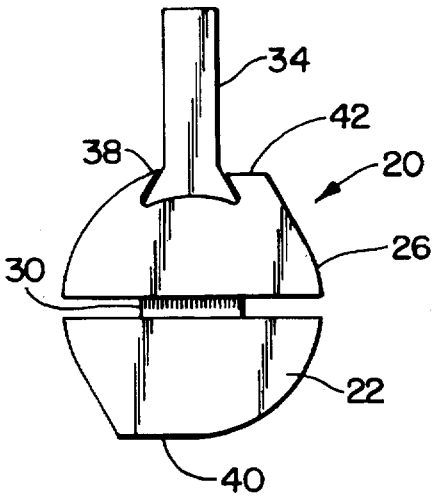
FIG. 4 is a bottom view of the rotator member.
Figure 5:
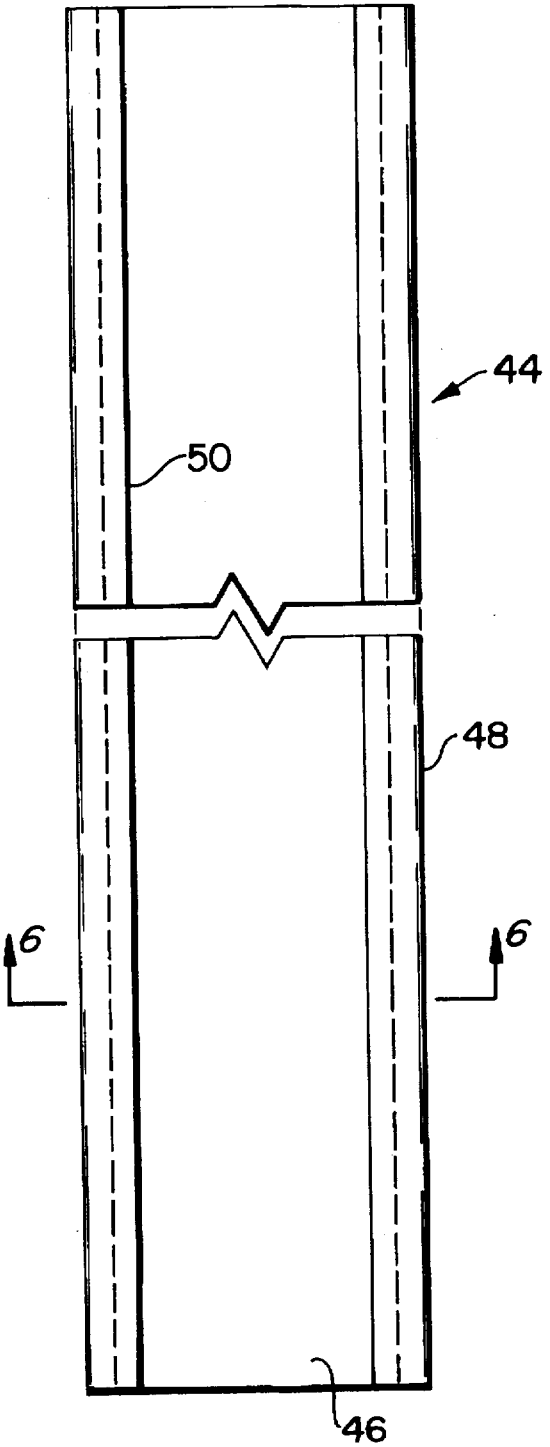
FIG. 5 is a top view of the channel guide with the channel side walls shown in phantom.
Figure 6:
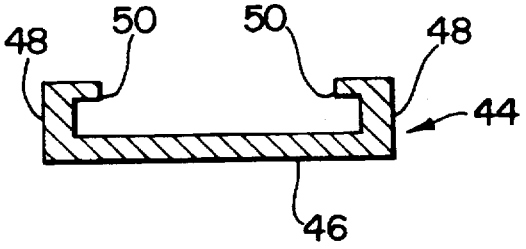
FIG. 6 is a sectional view of the channel guide taken along line 6—6 in FIG. 5.
Figure 9:
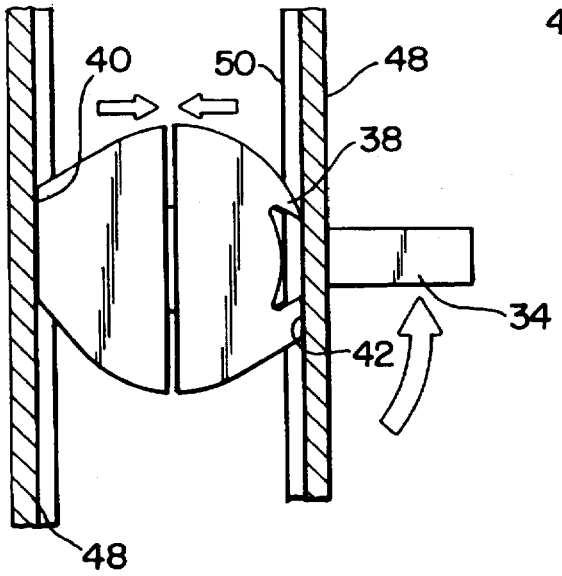
FIG. 9 is a bottom view of the rotator member shown positioned in the channel guide in a locked or engaged position.
Figure 10:
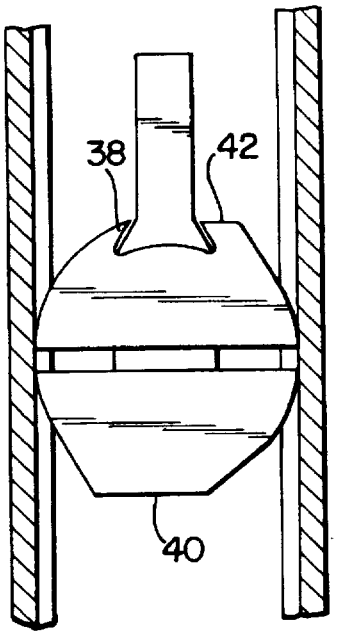
FIG. 10 is a bottom view of the rotator member shown positioned in the channel guide in a unlocked position.

As shown in FIGS. 4, 9 and 10, the eccentric cam surface includes primary cam-locking face 40 and secondary cam locking face 42. The primary and secondary cam-locking faces are oriented such that their surfaces are parallel to one another and to the gap separating the opposing sides of the rotator member. Further, the cam locking faces are positioned substantially on opposite sides of the eccentric cam surface. Finally, a resilient edge member 38 is provided as shown in FIG. 4.

According to the invention, when rotator member 20 is positioned as shown in FIGS. 7 and 10, primary cam-locking face 40 and secondary cam-locking face 42 do not engage channel side walls 48 and the rotator member will be in its unlocked position for receiving a socket. By comparison, when the rotator member is pivoted about its central axis in the channel guide to the position as shown in FIGS. 8 and 9, so that primary cam-locking face 40 and secondary cam-locking face 42 engage channel side walls 48, the opposing sides of base 22 will be compressed inwardly toward the central axis. As a result of such compression, the opposing sides of the socket-receiving member 24, located above the resilient bridge member, will be forced outwardly from one another as shown in FIG. 8. The outward movement of the opposing sides of the socket-receiving member 24 causes the outer surface of the box member 33 and cylindrical alignment head 28 to engage the interior side walls of a socket drive aperture to be retained on the socket holder system.

Further, according to the invention, resilient edge member 38 is provided to render a spring-like detent. The resilient edge member assists in maintaining the rotator member in its locked position as shown in FIG. 9, once it has been placed in that position. As can be seen from FIG. 9, the spring pressure of resilient edge member 38 is directed against side wall 48 to resiliently inhibit movement of the rotator member 20 when its positioned as shown in FIG. 9. Further, edge member 38 provides resilience necessary to allow rotator member 20 to disengage from the position shown in FIG. 9 when it is rotated in a clockwise direction to an unlocked position shown in FIG. 10. In particular, the manual rotational force in a clockwise direction, which is imparted by a user on rotator arm 34, will cause resilient edge member 38, to bend inwardly toward the central axis of the rotator member, so it may be disengaged from its locked position shown in FIG. 9.

Figure 11:
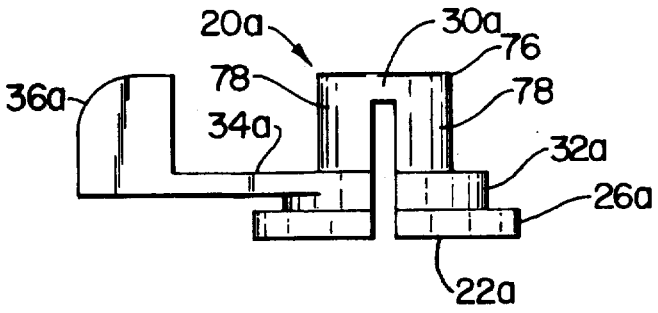
FIG. 11 is a side elevation view of a rotator member according to a second embodiment of the invention.
Figure 12:
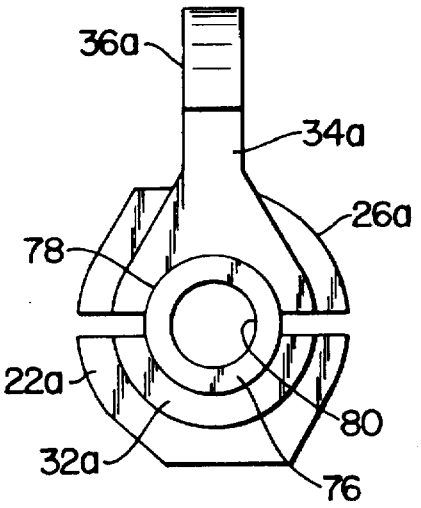
FIG. 12 is a top view of the rotator member according to FIG. 11.
Figure 13:
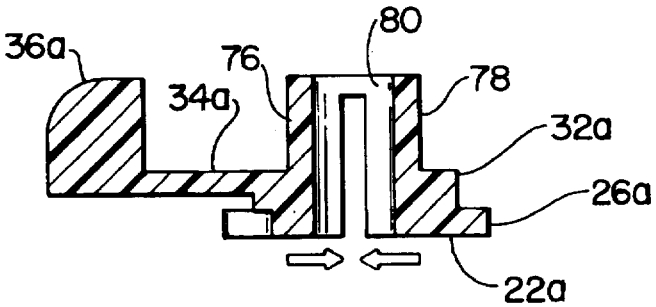
FIG. 13 is a bottom view of the rotator member according to FIG. 12.

A second embodiment of the invention designed for operation with interchangeable bit members having integral shafts (as opposed to shaft receiving members) is shown in FIGS. 11–13. The second embodiment is formed as described above with respect to FIGS. 1–10 except that in place of the socket-receiving member, a shaft receiving member 76 is provided axially aligned with and projecting upwardly from the lower body 32*a*. The second embodiment will be described generally with reference to interchangeable bit members having integral shafts. It should be understood that such interchangeable bit member terminology is intended to include all manner of bits having integral shafts, as well as detachable shafts for multi-component tools, e.g. a router bit shaft having interchangeable bits which may be positioned thereon.

For convenience, references to elements in the second embodiment corresponding to common elements in the first embodiment will be designated using the same reference numerals except that the suffix "a" will be added for clarity.

As shown in FIGS. 11–13, the shaft receiving member 76 is advantageously comprised of an outer casing 78 defining an inner bore 80 aligned with the rotator member axis. As with the previous embodiment, a rotator arm 34*a* is formed outwardly projecting from the rotator member 20*a*, spacedly offset from the base 22*a*. The rotator arm 34*a* is preferably attached to an upper portion of the lower body member so as to avoid interfering with the operation of the device.

According to the second embodiment of the invention, the base portion 22*a*, the lower body portion 32*a* and the shaft receiving member 76 are substantially divided along the central rotator member axis to form two opposing sides separated by a gap. The two sides of the rotator member are joined together by a resilient bridge member 30*a*. In the second embodiment described herein the resilient bridge member 30*a* may advantageously be integrally formed with each of the opposing sides of the shaft receiving member defined by the outer casing 78. The resilient bridge member 30*a* is preferably positioned at the distal end of the shaft receiving member, opposite from the base 22*a* as shown in FIGS. 11–13. In this manner, when the rotator member 20*a* is pivoted within the channel guide 44*a* so that the eccentric cam surface 26*a* engages the channel guide side walls 48*a*, the opposing sides of the shaft receiving member defined by the outer casing 78 will be compressed toward the rotator member central axis as bridge member 30(*a*) is deformed.

When an interchangeable bit member having a shaft formed thereon is to be stored in the second embodiment according to the invention, the shaft of the bit member is inserted within the inner bore 80 defined by the outer casing 78. Subsequently, upon pivoting the rotator member 20*a* within the channel guide 44*a*, the opposing sides of the shaft-receiving member 76 located below the resilient bridge member 30*a*, will be forced toward one another by a pivoting action about the resilient bridge member. The inward pivoting or flexing of the opposing sides of the shaft-receiving member 76 causes the inner bore 80 to decrease in diameter, with the result that a bit member shaft will be engaged by the inner surface of the outer casing 78. In this manner, a bit member having an integral shaft may be retained on the holder system. In all other respects, e.g. operation of the eccentric cam member and its spring lock engagement with the channel guide, the operation of the second embodiment of the invention is as described above with respect to the first embodiment.

Figure 14:
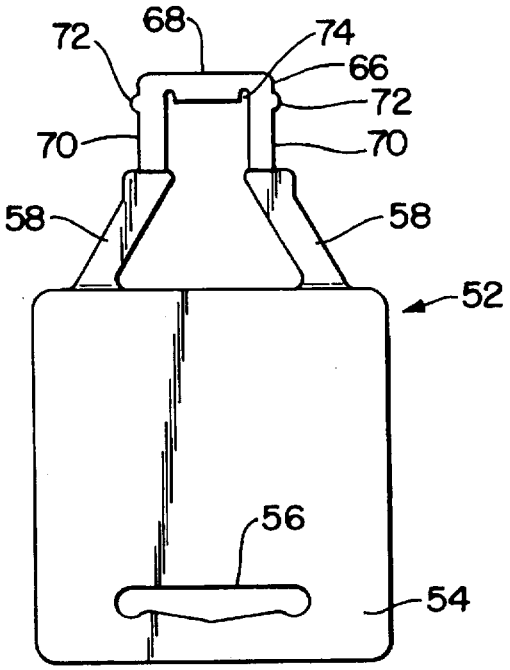
FIG. 14 is a side elevation view of a display part according to the invention.
Figure 15:
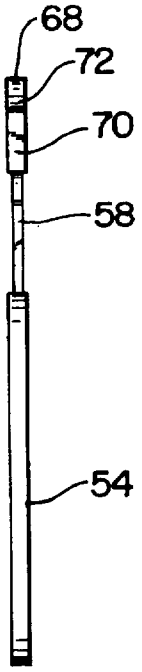
FIG. 15 is a side view of the display part according to FIG. 14.
Figure 16:
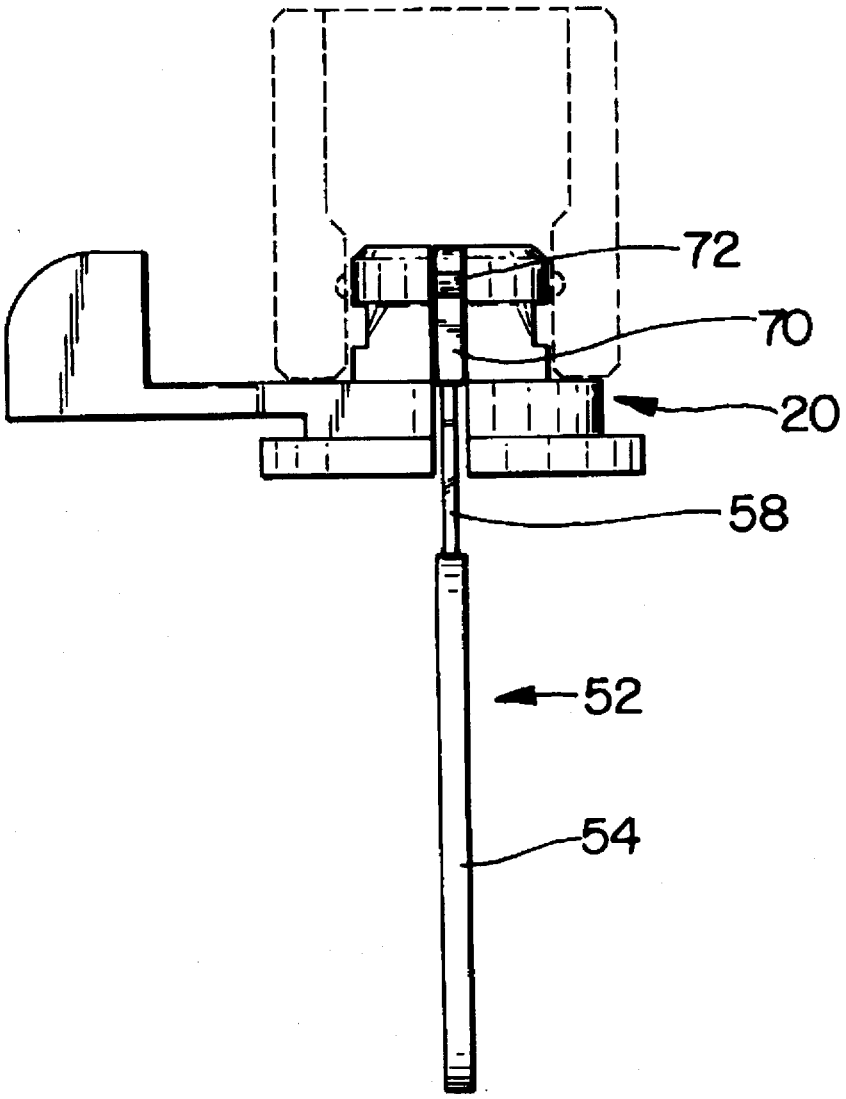
FIG. 16 is a side view of the display part in FIG. 14 interfitted with the rotator member of FIG. 1 with a socket shown in phantom.

As shown in FIGS. 14–16, a display part 52 is provided for facilitating convenient display of a ratchet socket or other type of tool bit mounted on rotator member 20 in a retail environment. The display part 52 interfits with the rotator member 20 so as to cause the rotator member to securely engage a socket thereon, without the need for channel guide 44. The display part includes a tab portion 54 having a hook aperture 56 and two flexible rotator member receiving arms 58 formed thereon. The tab portion 54 as shown in FIGS. 14–16 is generally planar with and has a square shape. Significantly however, the invention is not so limited and the tab portion may be formed in any desired style convenient for a particular type of display rack. Hook aperture 56 is provided to allow convenient hanging placement of the display part 52 on a display board in a retail outlet and can be formed on any convenient part of the tab portion 54 which does not interfere with the operation of the rotator receiving arms and related parts as described below.

As shown in FIG. 14, the receiving arms 58 project outwardly from one edge of the tab portion and angle toward one another in a common plane, in a direction away from the tab edge from which they project. It should be noted that the mounting position of the receiving arms on the edge of the tab portion 54 is not intended as limiting the invention, and such receiving arms may also project from a different part of the tab portion in accordance with the invention. The receiving arms 58 are connected at their distal ends by a U-shaped head unit 66. The head unit is comprised of two parallel spaced frangible lugs 70, each connected on one end to a distal end of one of the flexible receiving arms 58 and on an opposite end to a connector portion 68 as shown in FIG. 14.

As best seen in FIG. 15, the frangible lugs 70, connector portion 68 and receiving arms 58 are formed in a common plane. The frangible lugs 70 and connector portion 68 have a thickness "T" approximately equal to the gap formed between opposing sides of the rotator unit 20 as described above. For improved flexibility, the receiving arms 58 may be formed from a somewhat thinner material. The frangible lugs 70 are spaced apart from one another a distance approximately equal to a distance W associated with the width of the resilient bridge member 30 formed on the rotator unit 20. The frangible lugs each have formed on an outwardly facing surface a snap-lock socket engaging nub 72 for lockingly engaging a socket drive aperture when a socket drive aperture is press fit over the head unit 66. A groove 74 is provided where the frangible lugs 70 and connector portion 68 are joined together to provide the necessary resilience for such snap-lock engagement of the engaging nubs 72 with a socket drive aperture. With the exception of the socket engaging nubs 72, the frangible lugs 70 are dimensioned so that their outer profile generally matches the outer profile of the socket receiving member 24 (when viewed in a direction transverse to the rotator member gap).

The entire display unit is preferably formed from plastic and may advantageously be manufactured by means of an injection molding process commonly known among those skilled in the art. However, the invention is not so limited and alternative materials and manufacturing methods may also be used.

In order to use the display part 52 according to the invention, the rotator member 20 is positioned between the receiving arms with the cylindrical alignment head 28 facing the display part connector portion 68. The rotator member 20 is then slid into engagement with the display part 52 so that the frangible lugs 70 and connector portion 68 snugly interfit with the gap formed between opposing sides of the rotator member. As indicated above, the receiving arms 58 are flexible. They are formed in this manner so that they can be bent 90 degrees to allow for the efficient insertion of the U-shaped head unit 66 into a socket via automatic assembly equipment.

As noted above, the frangible lugs 70 are advantageously dimensioned so that their outer profile generally matches the exterior of the rotator member 20 in the area of the socket receiving member 24, except for the socket engaging nubs 72, which protrude outwardly from the rotator member in the area of the cylindrical alignment head 28. Accordingly, once the display part 52 has been securely interfitted with the rotator member 20, a ratchet socket can be mounted on the interfitted combination of the two parts 20 and 52 with the socket drive aperture inserted onto the socket receiving member 24. In such case, the snap-lock action of the socket engaging nubs 72 will lock into a socket drive aperture, thereafter preventing its removal.

Once mounted on the interfitted combination of the display part 52 and rotator member 20, a socket can only be removed by destroying the display part. More specifically, in order to remove a socket, a user must exert a force upon the interfitted combination of the two units 20 and 52 sufficient to shear one of the frangible lugs 70 off the receiving arms 58, or break the joint between the frangible lugs 70 and the connector portion 68. Either of these actions will destroy the structural support maintaining the socket engaging nubs 72 locked into position within the drive aperture of a socket, thus permitting the socket to be freely removed.

Although particular preferred embodiments of the invention have been disclosed in detail for illustrated purposes, it will be recognized that variations or modifications of the disclosed invention, including the use of different materials, and socket-receiving members having cam different designs, lie within the scope of the present invention.

I claim:

1. A holder system for securely storing one or more interchangeable bit members having integral shaft receiving members, said system comprising:

(a) a rotator member comprised of a base portion formed transverse to a central axis and having an eccentric cam surface defined on its outer periphery;

a cylindrical lower body formed on top of said base portion and projecting axially upward therefrom, the circular perimeter defined by said lower body inwardly offset from said eccentric cam surface;

a receiving member axially aligned with and projecting upwardly from said lower body;

said base portion, said lower body, and said receiving member divided along said central axis to form two opposing sides separated by a gap, said two sides joined by a resilient bridge member; and (b) channel guide means comprised of opposing channel sidewalls formed on an elongated channel base;

said base of said rotator member positioned within said channel guide means between said opposing side walls, whereby rotation of said rotator member about said central axis causes said sidewalls to selectively engage said eccentric cam surface, said engagement causing said resilient bridge member to flex so that the two opposing sides of said receiving member pivot outwardly from said central axis to engage a shaft receiving member of a bit.

2. The holder system according to claim 1 wherein said resilient bridge member is connected to said opposing sides of said lower body portion.

3. The holder according to claim 1 wherein said receiving member is comprised of a box member formed on said lower body and a cylindrical alignment head projecting upwardly from said box member.

4. The holder according to claim 3 wherein said resilient bridge member is connected to said opposing sides at said box member.

5. The holder according to claim 1 wherein said opposing channel side walls are formed parallel to one another and project upwardly from an elongated channel base along the length thereof and an inwardly projecting retaining lip is defined on an upper edge of said opposing channel side walls for retaining said rotator member in position between said opposing channel side walls.

6. The holder according to claim 1 wherein said eccentric cam surface includes at least two parallel opposing cam locking faces for maintaining said base in a stationery locking position relative to said channel guide means.

7. The holder according to claim 6 wherein said eccentric cam surface includes at least one resilient edge member to provide a detent when said rotator member is rotated to a position where said opposing cam locking surfaces engage said channel side walls.

8. The holder according to claim 1 further comprising a rotator arm outwardly projecting from said rotator member above said base portion and transverse to the direction of said central axis.

9. The holder according to claim 8 wherein said rotator arm is connected to said lower body, spacedly offset from said base.

10. A holder system for securely storing one or more bits for a tool, said system comprising:

(a) a rotator member comprised of:

a base portion formed transverse to a central axis and having an eccentric cam surface defined on its outer periphery, said eccentric cam surface including at least two parallel opposing cam locking faces;

a cylindrical lower body formed on top of said base portion and projecting axially upward therefrom, the circular perimeter defined by said lower body inwardly offset from said eccentric cam surface;

a receiving member axially aligned with and projecting upwardly from said lower body, said receiving member comprised of a box member formed on said lower body and a cylindrical alignment head projecting upwardly from said box member;

said base portion, said lower body, and said receiving member divided along said central axis to form two opposing sides separated by a gap, said two sides joined by a resilient bridge member at one of said lower body portion and said receiving member; and (b) channel guide means, comprised of opposing channel sidewalls, said opposing side walls formed parallel to one another and projecting upwardly from an elongated channel base along the length thereof, and an inwardly projecting retaining lip defined on an upper edge of said side walls for retaining said rotator member in position between said side walls;

said base portion of said rotator member positioned within said channel guide means between said opposing side walls, whereby rotation of said rotator member about said central axis causes said sidewalls to selectively engage said eccentric cam surface, said engagement causing said resilient bridge member to flex so that the two opposing sides of said receiving member pivot outwardly from said central axis to engage a tool bit.

11. The holder of claim 10 further comprising a rotator arm outwardly projecting from said rotator member above said base portion and transverse to the direction of said central axis.

12. A bit holder system for securely storing one or more interchangeable bit members having integral shaft members, said system comprising:

(a) a rotator member comprised of a base portion formed transverse to a central axis and having an eccentric cam surface defined on its outer periphery;

a lower body formed on top of said base portion and projecting axially upward therefrom, the perimeter defined by said lower body inwardly offset from said eccentric cam surface;

a shaft receiving member axially aligned with and projecting upwardly from said lower body;

a rotator arm outwardly projecting from said rotator member above said base portion and transverse to the direction of said central axis;

said base portion, said lower body, and said shaft receiving member divided along said central axis to form two opposing sides separated by a gap, said two sides joined by a resilient bridge member; and (b) channel guide means comprised of opposing channel sidewalls formed on an elongated channel base;

said base of said rotator member positioned within said channel guide means between said opposing side walls, whereby rotation of said rotator member about said central axis causes said sidewalls to selectively engage said eccentric cam surface, said engagement causing said resilient bridge member to flex so that the two opposing sides of said shaft receiving member flex inwardly toward said central axis to engage a shaft.

13. A holder system for securely storing one or more interchangeable bit members, said system comprising:

(a) a channel guide comprised of a pair of opposing channel sidewalls formed on an elongated channel base;

(b) a rotator member rotatably mounted within said channel guide and configured for locking engagement with at least one of said interchangeable bit members when rotated to a locking position.

14. The holder system according to claim 13 wherein said rotator member is axially divided to form opposing sides separated by a gap, said opposing sides joined by a resilient bridge member.

15. The holder system according to claim 13 wherein said rotator member is comprised of a base portion formed transverse to a central axis and having an eccentric cam surface defined on its outer periphery.

16. The holder system according to claim 15 wherein said rotator member is comprised of a cylindrical lower body formed on one side of said base portion and projecting axially upward therefrom, a perimeter defined by said lower body inwardly offset from said eccentric cam surface.

17. The holder system according to claim 16 further comprising a receiving member axially aligned with and projecting upwardly from said lower body.

18. The holder system according to claim 15 wherein said eccentric cam surface includes opposing cam locking faces for maintaining said base in a stationery locking position relative to said channel guide.

19. The holder system according to claim 18 wherein said eccentric cam surface includes at least one resilient edge member to provide a detent when said rotator member is rotated to said locking position.

20. The holder system according to claim 14 wherein said resilient bridge member is connected to said opposing sides at one of a lower body portion and a receiving member.

21. The holder according to claim 13 further comprising a rotator arm radially projecting from said rotator member.

* * * * *